US006510713B1

(12) United States Patent
Shima

(10) Patent No.: US 6,510,713 B1
(45) Date of Patent: Jan. 28, 2003

(54) COMPOUND NEEDLE

(75) Inventor: Masahiro Shima, Wakayama (JP)

(73) Assignee: Shima Seiki Mfg. Ltd., Wakayama (JP)

( * ) Notice: Subject to any disclaimer, the term of this patent is extended or adjusted under 35 U.S.C. 154(b) by 282 days.

(21) Appl. No.: 10/089,078

(22) PCT Filed: Oct. 25, 2000

(86) PCT No.: PCT/JP00/07484

§ 371 (c)(1),
(2), (4) Date: Apr. 10, 2002

(87) PCT Pub. No.: WO01/31102

PCT Pub. Date: May 3, 2001

(30) Foreign Application Priority Data

Oct. 27, 1999 (JP) ..... 11/305485

(51) Int. Cl.[7] ..... D04B 35/06
(52) U.S. Cl. ..... 66/120
(58) Field of Search ..... 66/116, 120, 123, 66/124

(56) References Cited

U.S. PATENT DOCUMENTS 4,043,153 A * 8/1977 Lindner et al. ..... 66/120
5,937,673 A * 8/1999 Shima ..... 66/120
6,233,977 B1 * 5/2001 Schuler et al. ..... 66/120
6,339,942 B1 * 1/2002 Majer et al. ..... 66/116
6,422,045 B1 * 7/2002 Morita et al. ..... 66/120

FOREIGN PATENT DOCUMENTS

JP 2946323 B 7/1999

* cited by examiner

*Primary Examiner*—Danny Worrell
(74) *Attorney, Agent, or Firm*—Arent Fox Kintner Plotkin & Kahn PLLC

(57) ABSTRACT

A compound needle which includes a needle body 3 having a needle hook 15 at a front end thereof and a slider 5 having tongues 31*a*, 31*b* formed by overlapping two blades 11*a* and 11*b* with each other and is so structured that the needle body 3 and the slider 5 are individually movable back and forth in the state in which the blades 11*a* and 11*b* of the slider 5 are supported in a blade groove 17 formed in the needle body 3, wherein a partition wall 41 having thickness smaller than that of the needle hook 15 of the needle body 3 is formed in the blade groove 17 and the blades 11*a* and 11*b* of the slider 5 are accommodated in the blade groove 17 to sandwich the partition wall 41 therebetween, to thereby provide a reduced sliding resistance and a reduced degree of stretch of the blades when the blades are advanced beyond the needle hook.

1 Claim, 6 Drawing Sheets

COMPOUND NEEDLE

TECHNICAL FIELD

The present invention relates to a knitting needle used in a knitting machine. More particularly, the present invention relates to a compound needle comprising a needle body having a needle hook at its front end and a tongue constructed to be movable relative to the needle body and formed at the front end to cooperate with the needle hook so as to open and close the needle hook.

BACKGROUND ART

There is known a compound needle which comprises a needle body having a needle hook at its front end and a slider and is constructed so that the needle body and the slider can move relative to each other to open and close the needle hook. The applicant previously proposed this type of compound needle in Japanese Patent No. 2946323.

The previously proposed compound needle is so constructed that two blades of the slider are accommodated in an overlapped relation in a blade accommodation groove formed in the needle body. The blades are formed to have thickness smaller than width of the groove so as to form a gap between the blades and the groove walls so that the blades can be supported to freely advance and retract in the groove.

In the knitting machine using the compound needles as noted above, front ends of the two blades of the slider are brought into abutment with outward inclined surfaces of the needle hook of the needle body at the front end thereof, to be diverged right and left and then a knitting needle on the opposite needle bed is moved into the space formed between the two diverged blades advanced beyond the needle hook, whereby transference of a loop is performed. The space formed between the two blades varies depending on the widthwise dimension of the needle hook formed at the front end of the needle body. A rough gauge knitting machine uses the compound needles each having a large needle hook and, with increase in size of a stitch formed, the size and thickness of the needle hook increase. In the knitting machine disclosed by Japanese Patent No. 2946323 as previously cited, the two blades are placed on a center line of the needle passing through the front end of the needle hook in the overlapped relation in the blade accommodation groove. In the case of a compound needle of rough gauge and large thickness, this presents the disadvantage that when the blades are advanced beyond the needle hook, the slider is abutted with the needle hook and is diverged right and left with increased sliding resistance, so that a burden is imposed on the slider and the needle hook. Further, when the blades are moved to their advanced positions beyond the needle hook, the stretch of the blades increases to a large extent. This presents the problem for a knitting machine comprising a pair of front and back needle beds which are arranged in opposition to each other and on which knitting members, such as a sinker and a loop presser, are disposed adjacent to the compound needles, so as to be advanced and retracted with respect to a needle bed gap. Specifically, in this knitting machine, there is the possibility that when transference of a loop is performed, the blades may move closely to the knitting members to occupy the space for allowing the loop on the tongues to be transferred to a needle on the receiving side, thus causing a knitting problem. Increase in spacing between the needle hook and the blade groove can allow the stretch of the blades to reduce to that extent, but this leads to elongation of the needle body and the slider with respect to the lengthwise direction of the needle and further to increase in size of the carriage and the knitting machine itself.

It is the object of the present invention to disclose improvement of a compound needle of the type noted above, wherein the blades of the slider can be allowed to be advanced beyond the needle hook with a reduced sliding resistance of the blades of the slider and a reduced degree of stretch of the blades, as compared with the conventional compound needle.

DISCLOSURE OF THE INVENTION

The present invention provides a compound needle which comprises a needle body having a needle hook at a front end thereof and a slider having a tongue formed by two blades being combined in an overlapped relation and is so structured that the needle body and the slider are individually movable back and forth in the state in which the blades of the slider are supported in a blade groove formed in the needle body, wherein a partition wall having thickness smaller than that of the needle hook of the needle body is formed in the blade groove and the blades of the slider are accommodated in the blade groove to sandwich the partition wall therebetween. This construction of the compound needle of the invention can provide the result that when the slider is advanced beyond the needle hook, the two blades, which are abutted with the front end of the needle hook and diverged right and left by the side surfaces of the needle hook at the front end thereof, are made to advance along lines deviating from a center line of the needle passing through the front end of the needle hook by the partition wall, so that the blades are stretched to a reduced extent in a widthwise direction of the needle, as compared with the conventional compound needle wherein two blades are advanced along the center line of the needle passing through the front end of the needle hook.

BRIEF DESCRIPTION OF THE DRAWINGS

FIG. 3-*c* is a plan view of the blades 11*a* and 11*b* in the combined state, FIG. 4-*a* is a sectional view of the forefront portion of the compound needle taken along line A—A of FIG. 1.

FIG. 5-*c* shows the blades which are in their advanced position beyond the needle hook; and FIG. 5-*d* shows a conventional compound needle whose blades are in their advanced position beyond the needle hook.

BEST MODE FOR CARRYING OUT THE INVENTION

Figure 1:
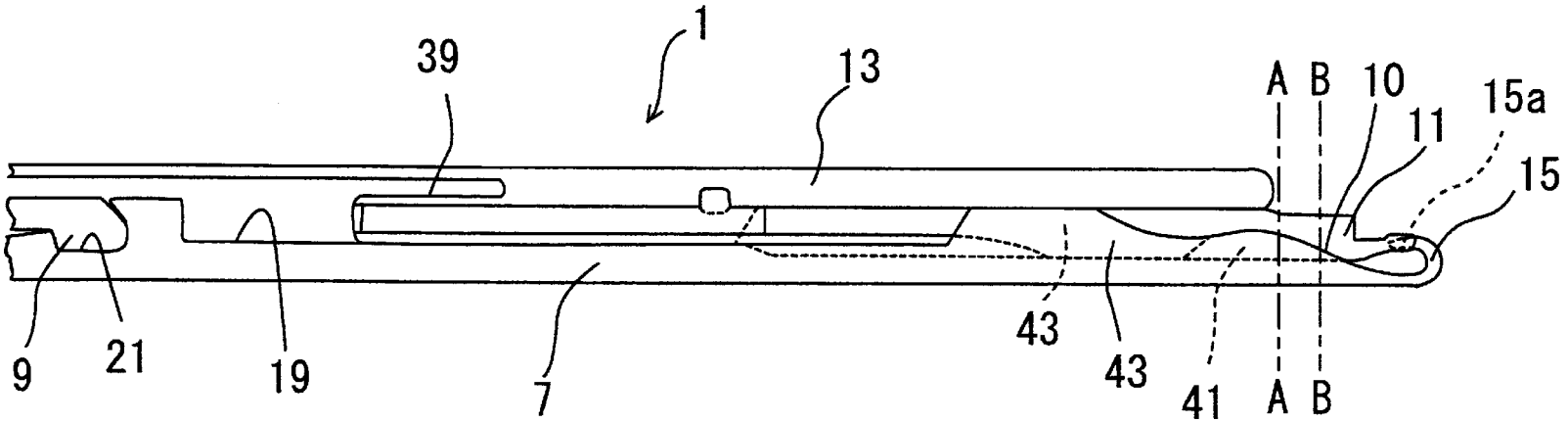
FIG. 1 is a view showing a forefront portion of a compound needle of the present invention which is in the state of being loaded in a needle groove formed in a needle bed.
Figure 2:
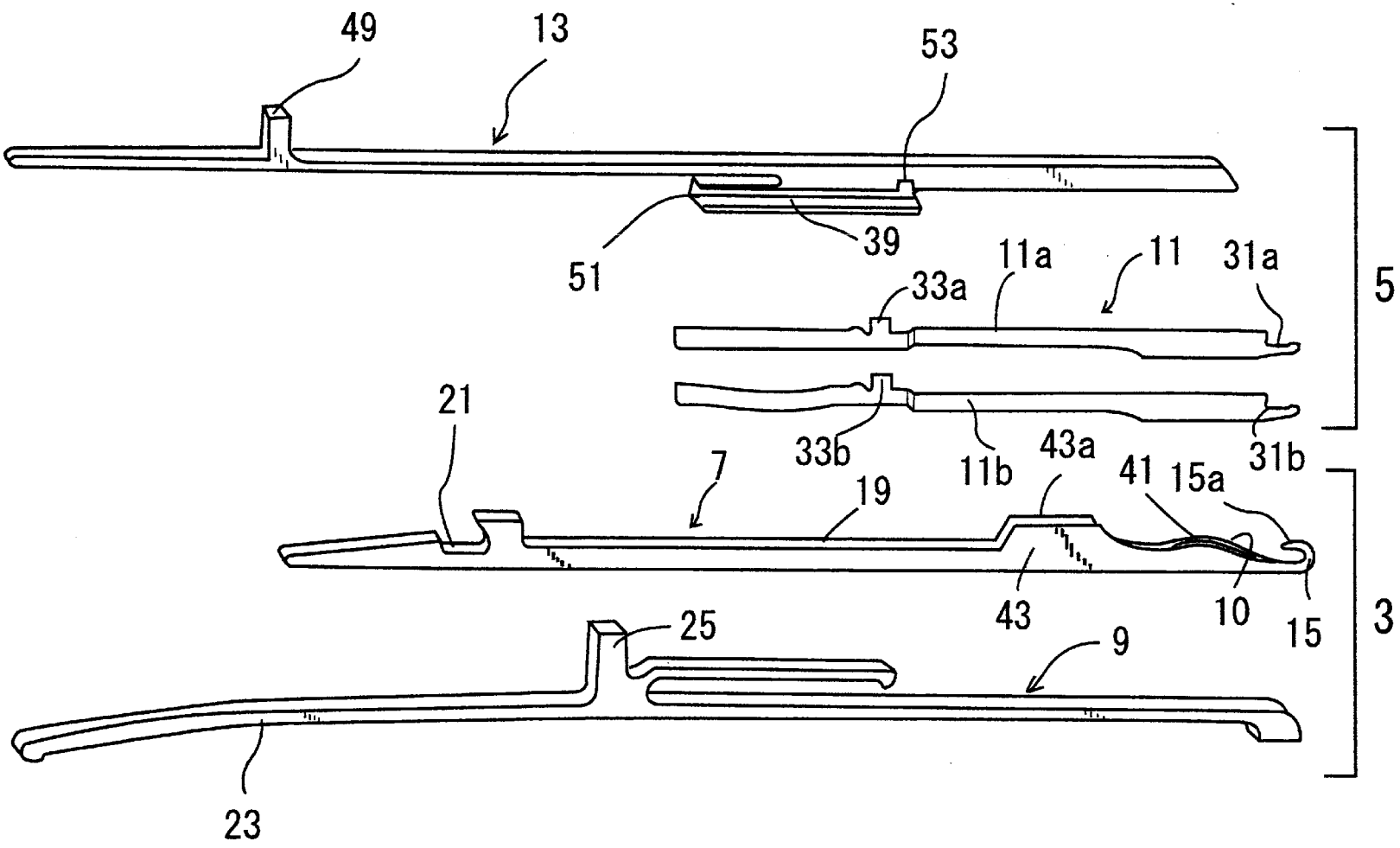
FIG. 2 is a view showing the detail of the respective parts of the compound needle, FIG. 3-*a* is a side view of the blades 11*a* and 11*b;*

A certain preferred embodiment of the present invention will be described below with reference to the accompanying drawings.

A compound needle of an embodiment of the invention comprises a needle body 3 and a slider 5. The needle body 3 comprises a needle hook member 7 and a needle jack 9 separate therefrom. While the needle body may be formed by these parts being integrally formed, the needle body 3 in the illustrated embodiment is formed by forming these individual parts in combination.

The needle hook member 7 is provided with a hook portion 15, a blade groove 17 for accommodating a blade portion 11, a center body portion 19 for supporting a lower arm of a slider body portion 13, and a concave portion 21, provided at a rear end portion of the needle hook member, for connecting a front end of the jack, when cited in the order of arrangement from the front end side. The needle hook member 7 and the needle jack 9 are formed to have the same thickness. The needle jack 9 is formed to have thickness slightly smaller than width of the needle groove and has a curved elastic leg 23 extending rearwardly from the concave portion 21 and having a rear end to abut with a bottom of the needle groove. It also includes a control butt 25 projecting from around the center of the body portion of the needle jack 9 to engage with a cam mounted on a cam carriage (not shown), so as to be operated to advance and retract, so as to make the needle body 3 advance and retract.

Figure 5:
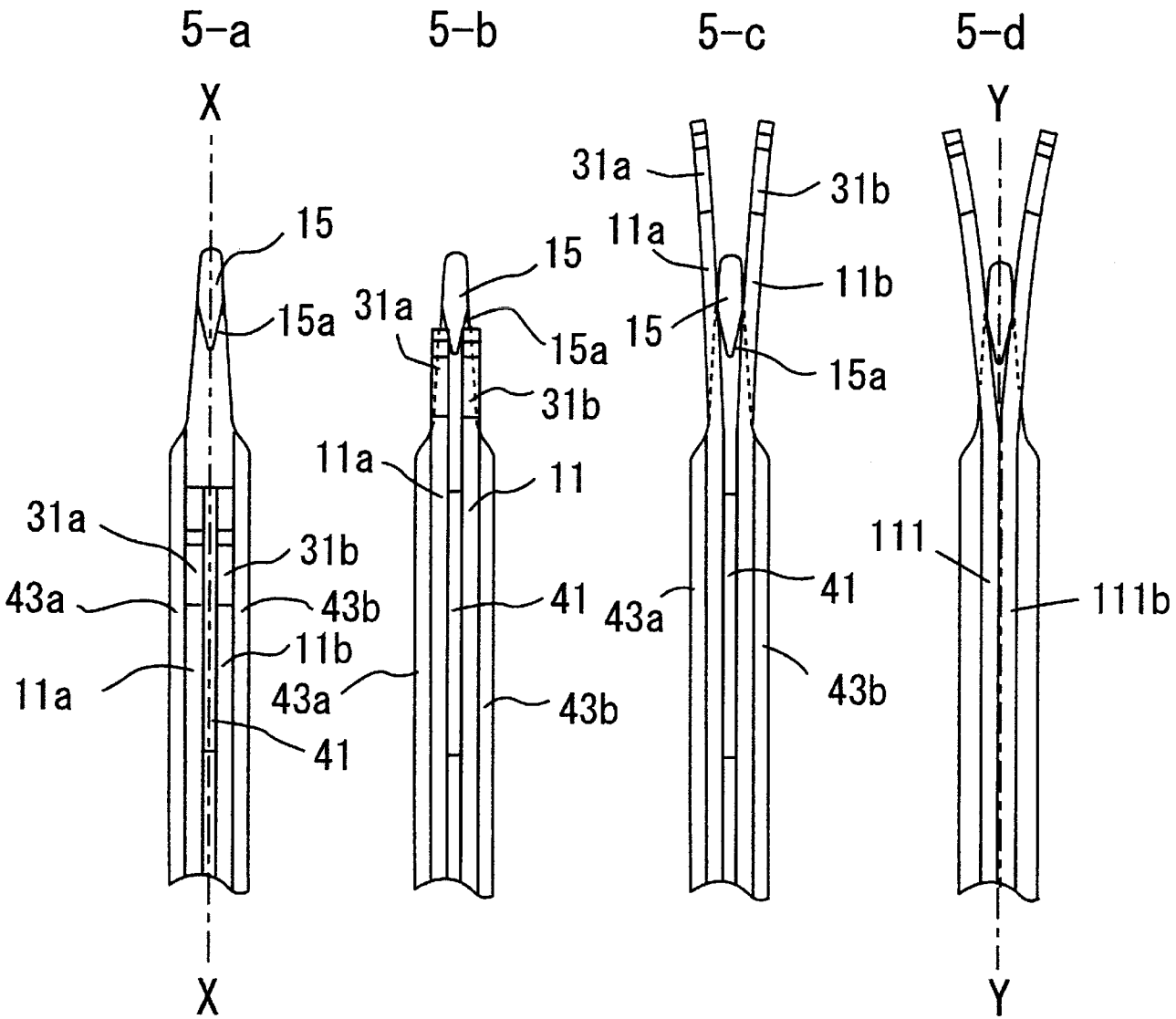
FIG. 5-*b* shows blades of the slider which are in abutment with a needle hook.

The needle hook member 7 has a partition wall 41 formed in the blade groove 17 at a front end portion thereof. The partition wall 41 is formed to be placed on a dashed line X—X passing through the front end of the hook 15 and drawn in a lengthwise direction of the needle 1 as shown in FIG. 5-*a* and projected vertically upwardly from the bottom of the blade groove 17. The partition wall 41 is formed to be identical in height to a throat portion 10 of the needle hook member 7 at a portion thereof on the front end side of the needle and be continuous to the bottom of the blade groove 17 at a portion thereof on the rear end side of the needle. The blade groove 17 is divided into two groove portions 17*a* and 17*b* by the partition wall 41, and the blades 11*a* and 11*b* are accommodated in the groove portions 17*a* and 17*b*, respectively, sandwiching the partition wall 41 therebetween.

Figure 3:
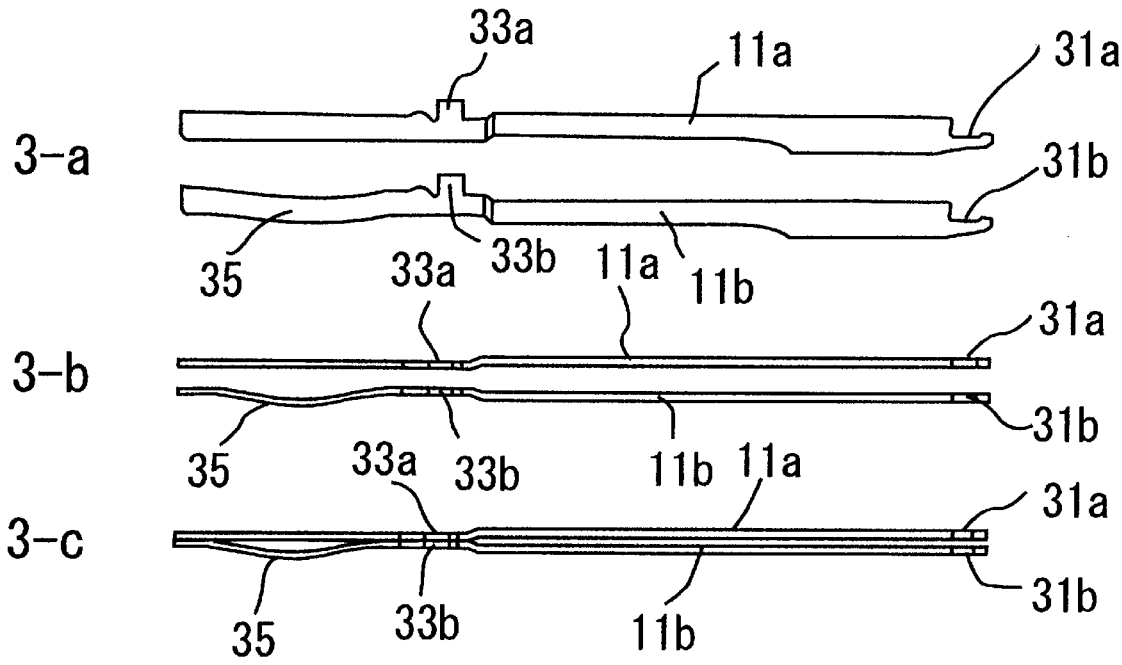
FIG. 3-*b* is a plan view of the blades 11*a* and 11*b;*.
Figure 4:
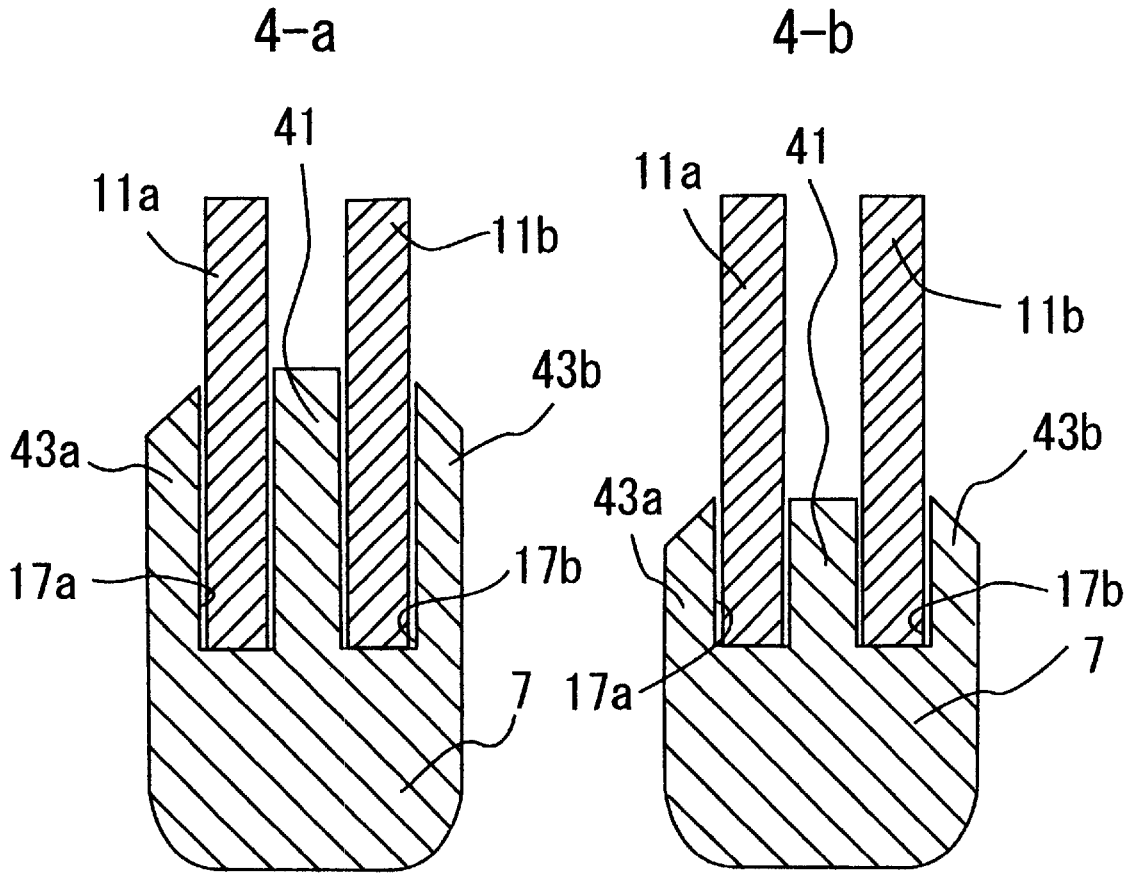
FIG. 4-*b* is a sectional view of the same taken along line B—B of FIG. 1, FIG. 5-*a* shows a slider which is in its retracted position.

The slider 5 comprises blades 11*a* and 11*b* and a slider body 13 formed separately from the blades. The blades are formed by two plates of generally identical in shape to each other being combined in an overlapped relation, as shown in FIG. 3, and are accommodated in the blade groove 17. The blades 11*a* and 11*b* have tongues 31*a* and 31*b*, formed at front end portions thereof, to abut with a front end portion 15*a* of the hook 15 and further have connecting portions 33*a* and 33*b*, formed at portions thereof on the rear side of the blade groove 17, to connect with the slider body 13. Each of the blades 11*a* and 11*b* is bent outwardly at a location close to the connecting portion 33*a*, 33*b* so that when the blades are in the combined state, they can extend forwardly, keeping a space therebetween substantially equal to thickness of the partition wall 41, as mentioned later. The blade 11*b* has a bend 35 formed therein. The bend 35 is put into abutment with inner side walls of the blade groove to prevent the slider 5 from moving awkwardly in association with the advancing and retracting motion of the needle body 3 and allow the needle body 3 and the slider 5 to advance and retract individually.

The slider body 13 has thickness identical to that of the needle body 3 and has a control butt 49, projected from a rear end portion thereof, for controlling the advancing and retracting motion of the needle body. 39 denotes a lower arm formed to be branched from the body portion and extended to a space in the center body portion 19 of the needle hook member 7. The lower arm 39 has a longitudinal slot 51 formed by cutting it at one side surface thereof and a thru hole 53 formed on the longitudinal slot 51. The projections 33*a* and 33*b* of the blade 11 are fixedly engaged in the thru hole 53 of the slider body 13 by caulking and the like.

Now, operation of the compound needle thus constructed will be described with reference to FIG. 5-*a* to FIG. 5-*d*. Shown in FIG. 5-*d* is a conventional compound needle which has no partition wall and is so structured that two blades are combined in an overlapped relation with each other at a widthwise center of the needle. For convenience of explanation, size of the needle hook and thickness of the blades are depicted in an exaggerated form and also the slider body covering the blade groove from the above is omitted from FIG. 5.

When the slider is in its retracted position with respect to the needle body 7, the blades 11*a* and 11*b* are respectively accommodated in the blade grooves 17*a* and 17*b* diverged right and left by the partition wall. Then, when the slider 5 is advanced with respect to the needle body 7, the blades 11*a* and 11*b* are abutted with the front end 15*a* of the needle hook and then are stretched along the sides of the needle hook at the front end 15*a* thereof, resulting in the state shown in FIG. 5-*c*.

According to the conventional compound needle according to which two blades 11*a* and 11*b* are combined in an overlapped relation and placed on a dashed line Y—Y passing through the front end of the needle hook and drawn in a lengthwise direction of the needle 1, when the blades 11*a* and 11*b* are advanced beyond the needle hook, they come to be stretched outwardly to a large extent. Thus, the sliding resistance is increased when the blades are advanced beyond the needle hook. In contrast to this, according to the compound needle of the illustrated embodiment, the partition wall allows the two blades to be advanced along lines deviating from a dashed line X—X passing through the front end of the needle hook and drawn in a lengthwise direction of the needle 1, and as such can allow the blades 11*a* and the 11*b* to be stretched to a small extent and can allow the sliding resistance to reduce. In addition, when the front ends of the blades 11*a* and 11*b* are extruded along the side surfaces 15*a* of the needle hook at the front end thereof, the blades 11*a* and 11*b* are brought into contact with the partition wall 41, which prevents portions of the blades 11*a* and 11*b* accommodated in the blade groove from being curved inwardly and, as a result, the blades 11*a* and 11*b* are prevented from being stretched out to a large extent.

Figure 6:
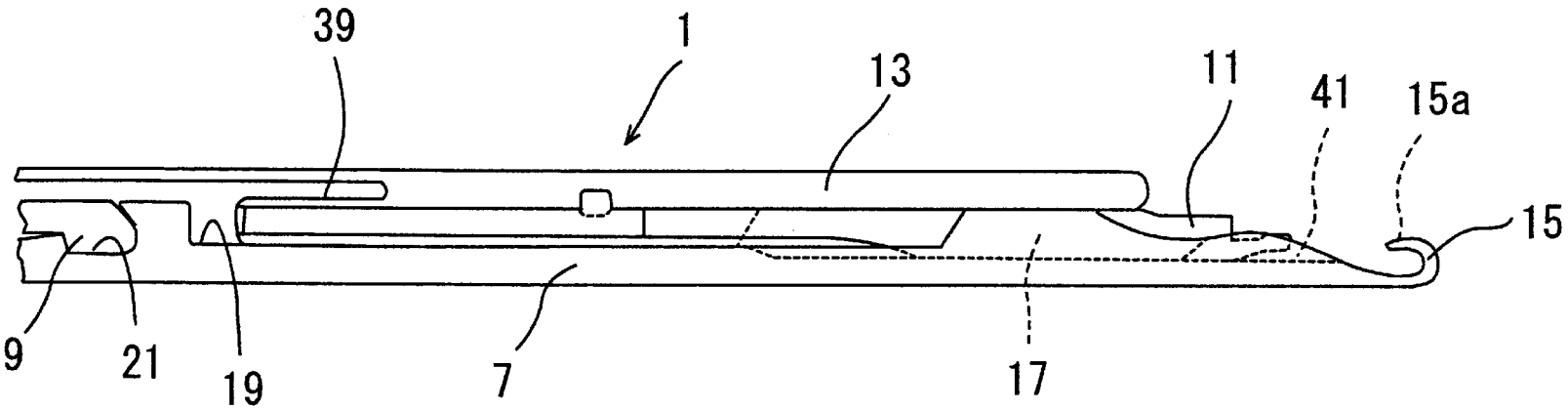
FIG. 6 shows a forefront portion of the compound needle of the present invention whose slider is in its retracted position.

Also, when the blades 11*a* and 11*b* are moved to their retracted position, as shown in FIG. 6, dirt and dust that may get into the space between the blades ha and 11*b* are pushed out by the partition wall 41. Hence, accumulation of the dirt and dust in the space between the blades 11*a* and 11*b* can be avoided, thus avoiding the possible problems resulting therefrom, such as hindrance of smooth sliding motion of the slider caused by the accumulated dirt and dust to cause unintended knitting results, such as a drop stitch and a confined stitch (the state in which a stitch is confined within the hook of the needle), and damage of the slider and the needle hook. It is to be noted that with increase in thickness of the partition wall, the sliding resistance and the stretch of the blades can be made smaller. While in the illustrated embodiment, the space for the partition wall is formed between the blades 11*a* and 11*b* by bending the blades 11*a* and 11*b*, the space for the partition wall may alternatively be formed therebetween by using a spacer to be inserted in between the two blades. The partition wall 41 in the blade groove 17 may be formed along the entire length of the blade groove. Alternatively, the partition wall may be formed at any other regions of the needle than the front end portion of the needle. It is preferable, however, that the partition wall 41 is provided in a front region of the blade groove including a region on the front end side of the needle, because the partition wall formed at the front end portion of the blade groove 17 can prevent the accumulation of the dirt and dust in the space between the blades 11*a* and 11*b*.

Capabilities of Exploitation in Industry

As mentioned above, the compound needle of the present invention can provide a reduced sliding resistance and a reduced degree of stretch of the blades when the blades are advanced beyond the needle hook, as compared with the conventional compound needle wherein the two blades are made to close contact with each other to be combined and accommodated on the center line of the needle in the blade groove.

I claim:

1. A compound needle which comprises a needle body having a needle hook at a front end thereof and a slider having a tongue formed by two blades being combined in an overlapped relation and is so structured that the needle body and the slider are individually movable back and forth in the state in which the blades of the slider are supported in a blade groove formed in the needle body, wherein a partition wall having thickness smaller than that of the needle hook of the needle body is formed in the blade groove and the blades of the slider are accommodated in the blade groove to sandwich the partition wall therebetween.

* * * * *